United States Patent [19]

Rohde

[11] 4,092,131

[45] May 30, 1978

[54] PROCESS AND APPARATUS FOR THE LOW-TEMPERATURE SEPARATION OF AIR

[75] Inventor: Wilhelm Rohde, Munich, Germany

[73] Assignee: Linde Aktiengesellschaft, Wiesbaden, Germany

[21] Appl. No.: 712,265

[22] Filed: Aug. 6, 1976

[30] Foreign Application Priority Data

Aug. 8, 1975 Germany ..... 2535488

[51] Int. Cl.[2] ..... B01D 53/04

[52] U.S. Cl. ..... 55/33; 55/62; 55/74; 62/13

[58] Field of Search ..... 55/25, 31, 33, 62, 68, 55/74; 62/13, 17, 18

[56] References Cited

U.S. PATENT DOCUMENTS

| | | | |
|---|---|---|---|
| 2,699,837 | 1/1955 | Van Note | 55/62 X |
| 3,210,950 | 10/1965 | Lady | 62/13 X |
| 3,280,574 | 10/1966 | Becker | 62/13 |
| 3,355,859 | 12/1967 | Karwat | 55/31 X |
| 3,967,464 | 7/1976 | Cormier et al. | 55/62 X |

*Primary Examiner*—Charles N. Hart
*Assistant Examiner*—Robert H. Spitzer
*Attorney, Agent, or Firm*—Millen & White

[57] ABSTRACT

In a process for the low-temperature separation of air into dry product gases wherein at least a portion of the entering air is cooled by indirect heat exchange in a heat exchanger against at least one of the product gases and is freed of impurities by an adsorption process prior to this heat exchange, the improvement which comprises freeing the air of substantially only $H_2O$ in the adsorption process and periodically interchanging the flow paths for the air and for the product gas, respectively, in the heat-exchanger.

6 Claims, 1 Drawing Figure

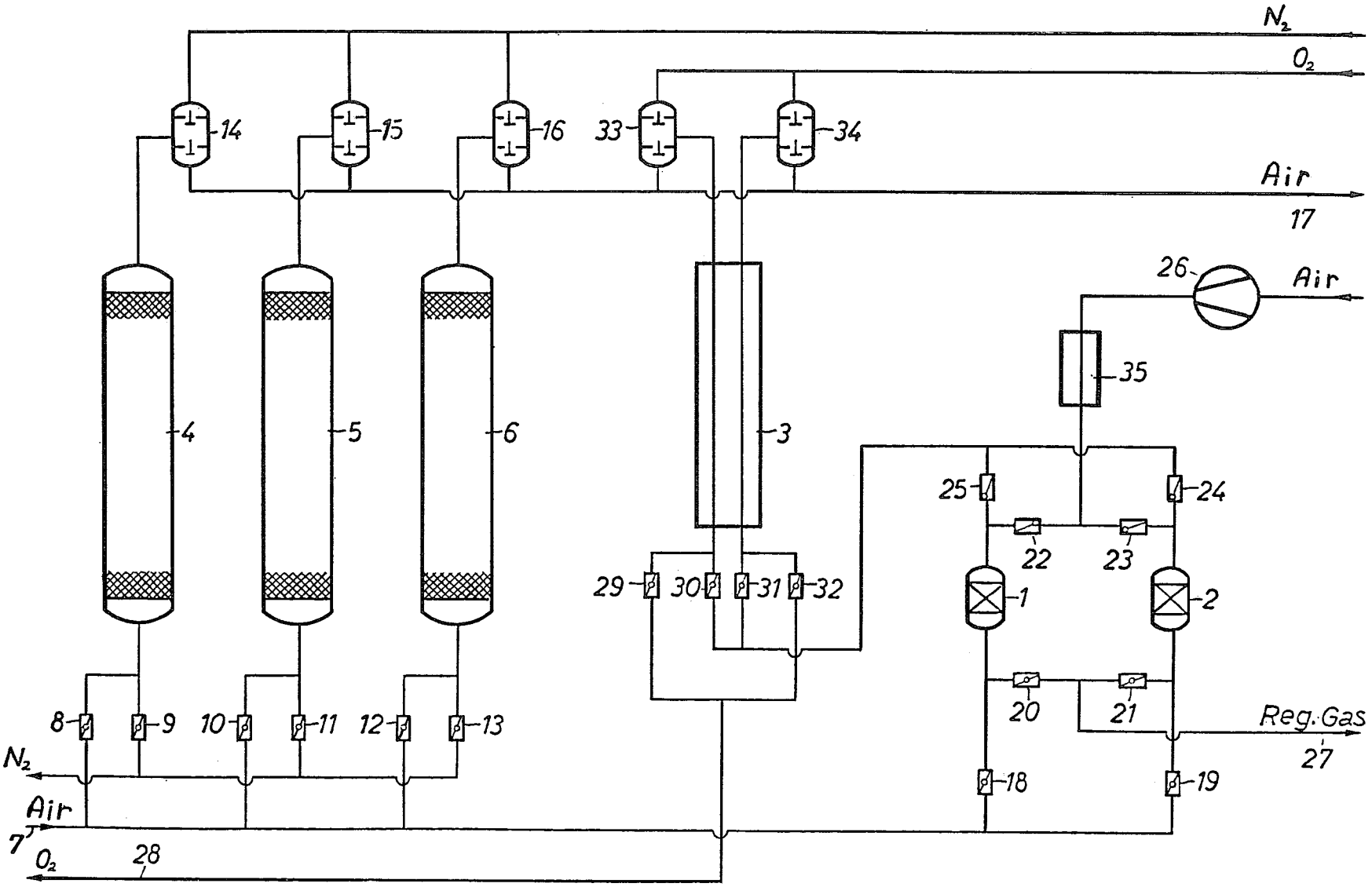
N2
O2
Air
17
Air
26
35
24
2
23
22
1
25
Reg. Gas
27
19
21
20
18
34
33
3
32
31
30
29
16
15
14
6
5
4
13
12
11
10
9
8
28
N2
Air
7
O2

PROCESS AND APPARATUS FOR THE LOW-TEMPERATURE SEPARATION OF AIR

BACKGROUND OF THE INVENTION

This invention relates to a process and apparatus for the low-temperature separation of air into dry product gases wherein at least a portion of the entering air is cooled by heat exchange against at least one of the product gases and is freed of impurities by an adsorption process prior to this heat exchange.

Such a process is utilized in all those cases wherein a large portion of the product gases nitrogen and oxygen is desired in the pure condition. In such an instance, the amount of purge gasrquired to resublime the impurities frozen out in the primary heat exchanger (reversing exchangers or regenerators) is not available. Consequently, the necessity arises to purify at least a portion of the entering air in an adsorption process.

In conventional methods of this type, a molecular sieve is ordinarily utilized as the adsorber. Apart from the fact that the molecular sieves are very expensive, disturbances in the operation within the molecular sieve unit frequently result in congealed deposits clogging the heat exchanger for the entering air, thereby causing plant shutdown.

SUMMARY OF THE INVENTION

An object of this invention, therefore, is to provide a more reliable and less expensive system.

Upon further study of the specification and appended claims, further objects and advantages of this invention will become apparent to those skilled in the art.

These objects are attained by providing that the air is exclusively dried in the absorption process and the flow paths for the air and/or the product gas in the heat-exchange device are periodically interchanged. By exclusively dried is meant that only $H_2O$ is removed entirely, whereas other impurities such as $CO_2$ are removed only to a negligible amount. For instance less than 1% of the $CO_2$ are removed from the $CO_2$ containing air stream when activated alumina, silica gel or the like is used as adsorbent.

The impurities which have not been removed in the adsorption process, such as, for example, hydrocarbons and carbon dioxide, are frozen out in the subsequent heat exchanger. Since the flow paths for the entering air and the product gas are periodically interchanged, the frozen-out impurities are again removed with the product gas. The impurities in the product gas, however, are insignificant with a purity requirement of up to 99.5%. If the adsorption station becomes inoperative due to a disturbance and the air enters the heat-exchange device together with impurities, then the only consequence is that the product gas contains the entire impurities of the air. However, the plant need not be shut down. Accordingly, the use of the process of this invention results in a greater operating reliability. Since the reversible heat-exchange device provided downstream of the dryers is operated with dry air, there is no corrosion problem, and a long lifetime can be expected.

Suitably, a dry gel is utilized for the removal of the water. This leads to further significant advantages, besides substantially lower initial investment costs. Dry gel operates economically even at ambient temperatures of, for example, 25° C., and for this reason an expensive precooling with "Freon," as necessary in case of molecular sieves, can be dispensed with. Accordingly, it is preferred that the adsorption step be conducted at about 15° to 30° C. Moreover, additional advantages are obtained during the regeneration of the dry-gel adsorber. Thus, as compared to the molecular sieve adsorber, a smaller amount of air suffices for the regeneration, and this amount of air moreover need not be free of carbon dioxide. The permissibly low regeneration temperature of about 120° to 180° C. likewise affords advantages in the process technology. By dry gel is meant activated aluminia, silica gel or the like.

In an advantageous embodiment of the present invention, regenerators are utilized as the heat-exchange device, which are distinguished by especially high reliability in operation.

In another embodiment, the flow path interchange involves more than two conduits which are cyclically reversed so that a certain number of conduits are utilized for the product gas and one conduit is used for the compressed inlet air. As a consequence thereof, with approximately equal molar amounts of entering air and exiting gas, the flow volumes in the conduits are not so greatly different from one another as is the case if only one flow path each is available for the product gas and for the air.

Suitable for conducting the process of this invention is an apparatus comprising a dry-gel adsorption station and a heat-exchange device, as well as a system of conduits and valves for the periodic reversal of the flow paths in the heat-exchange device.

The process of this invention can also be conducted advantageously by means of an apparatus containing regenerators as the heat-exchange device.

DESCRIPTION OF PREFERRED EMBODIMENT

The process of this invention will be explained in greater detail with reference to an embodiment illustrated schematically in FIG. 1:

The FIGURE shows merely that portion of an air separation plant which is essential to the invention.

Two dry-gel adsorbers are denoted by reference numerals 1 and 2. Numeral 3 denotes a heat exchanger. Regenerators are numbers 4, 5 and 6.

Compressed air enters the plant at 7. A portion thereof is cooled, depending upon the switching position of the valves 8–16, in one of the regenerators 4–6 (primary heat exchangers) and fed via conduit 17 to the separation plant.

The remainder, about 20 to 30% of the feed air is dried, in accordance with this invention, in one of the two dry-gel adsorbers 1 or 2. The air is then cooled in secondary heat exchanger 3 against product oxygen and conducted via conduit 17 to the separation plant. The product oxygen leaves the plant via conduit 28. With the aid of the valves 29–34, the flow paths in heat exchanger 3 can be reversed. The operation of the absorbers 1 and 2 is periodically exchanged by switching over the valves 18–25, and the adsorber not in operation at that time is regenerated by means of air. This air is taken in by the blower 26 and heated to about 100° C. in a steam heater 35. The loaded regenerating air leaves the plant via conduit 27. An impure nitrogen product is passed through the regenerator in the usual manner.

The method according to FIG. 1 may be employed in a case in which for example 20,000 $Nm^3/h$ oxygen and 35,000 $Nm^3/h$ nitrogen shell be produced in pure state. This requires an air input of 100,000 $Nm^3/h$. According to the invention, about 20,000 $Nm^3/h$ of the incoming air are dried by a silica gel in one of the adsorbing zones 1 or 2, while the other one of the two adsorbing zones is regenerated.

The adsorbing system must be regenerated every 4 to 12 hours or more, for which purpose air of 120° to 180° C is blown through the adsorbing bed. The pathways of reversing exchanger 3 should be changed every 10 to 20 minutes by appropriately switching the valves 29–34 in order to remove the frozen out impurities.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the low-temperature separation of air into dry product gases wherein the entering air is divided into two portions, one portion being freed of impurities in an adsorption process and being then cooled by indirect heat exchange in a secondary heat exchanger against oxygen product gas and the other portion being cooled in a primary heat exchanger directly without an intermediate adsorption treatment, the improvement which comprises freeing said one portion of the air of substantially only $H_2O$ in the adsorption process by passing the air over a dry gel desiccant and periodically interchanging the flow paths for the air and for the oxygen product gas, respectively, in the heat-exchanger.

2. A process according to claim 1 wherein the secondary heat exchanger comprises regenerators.

3. A process according to claim 1 wherein the interchanging of the flow paths comprises more than two flow conduits which are cylically switched over so that in each case a number of conduits is utilized for the product gas and a smaller number of conduits is used for the inlet air.

4. A process according to claim 1, wherein said dry gel is activated alumina or silica gel.

5. A process according to claim 1, wherein said adsorption process comprises parallel interchangeable adsorbers and said adsorbers are regenerated with hot air.

6. A process according to claim 5, wherein the adsorber contains silica gel or activated alumina.

* * * * *